US005901863A

United States Patent [19]

Riga et al.

[11] Patent Number: 5,901,863

[45] Date of Patent: May 11, 1999

[54] CASKET DISPLAY SYSTEM

[75] Inventors: Dennis J. Riga, New Albany; Douglas E. Kellogg, Canal Winchester, both of Ohio

[73] Assignee: The York Group, Inc., Houston, Tex.

[21] Appl. No.: 08/789,152

[22] Filed: Jan. 24, 1997

[51] Int. Cl.[6] ..... A47F 7/00

[52] U.S. Cl. ..... 211/85.16

[58] Field of Search ..... 211/85.16, 133

[56] References Cited

U.S. PATENT DOCUMENTS

| | | | |
|---|---|---|---|
| D. 257,183 | 9/1980 | Bruce et al. . | |
| 1,169,157 | 1/1916 | Honold | 211/85.16 X |
| 1,841,412 | 1/1932 | Leicht | 211/85.16 |
| 2,937,768 | 5/1960 | Davis . | |
| 5,197,169 | 3/1993 | Gordon . | |
| 5,404,627 | 4/1995 | Shepherd . | |
| 5,405,017 | 4/1995 | Szabo et al. . | |
| 5,524,394 | 6/1996 | Szabo, Sr. et al. . | |
| 5,533,241 | 7/1996 | McConnell . | |

*Primary Examiner*—Alvin Chin-Shue
*Assistant Examiner*—Sarah Purol
*Attorney, Agent, or Firm*—Liddell, Sapp, Zivley, Hill & LaBoon, L.L.P.

[57] ABSTRACT

The present invention provides a display system for caskets, both for display prior to casket selection, e.g., in a showroom prior to purchase, and for display in actual use, e.g., in a viewing room and/or during a funeral or memorial service. The casket display system is easy to assemble in a short period of time, is lightweight enough for a single human to be able to lift and move any of its component parts, yet is strong and sturdy, giving the appearance of stability and mass, and is easily transportable. The casket display system of the present invention comprises a back wall panel, a bier formed by a plurality of casket-supporting cylinders, and at least one supporting member, wherein each supporting member is supported by at least one of the cylinders and provides support for the back wall panel. The back wall is completely supported by the supporting members, requiring no additional means of support. Each supporting means is attached to one or more of the cylinders. The cylinders may be interconnected by a connecting member, to provide enhanced support to the back wall supporting member and stability to the entire casket display system.

45 Claims, 12 Drawing Sheets

CASKET DISPLAY SYSTEM

BACKGROUND OF THE INVENTION

The present invention relates to display systems for caskets, which is useful for displaying caskets both prior to selection, e.g., in a showroom prior to purchase, and in actual use, e.g., in a viewing room and/or during a funeral or memorial service.

Various casket display devices are known in the art. One such device, a casket display rack or support, is disclosed in U.S. Pat. No. 2,937,768, issued May 24, 1960 ("the '768 patent"). The '768 patent discloses a two-tiered casket display rack having a rigid C-shaped frame-like structure for display of two caskets, on which a first casket is supported above a second, and which includes a dolly on which the lower casket is supported and lazy tongs for sliding the lower casket out from under the upper casket for display and opening. Similarly, U.S. Pat. No. 5,405,017, issued Apr. 11, 1995 ("the '017 patent"), discloses a two-tiered casket display rack and a structure having a back wall and two wing walls arranged perpendicularly to the back wall, the three walls forming an alcove for display of the caskets. The casket display devices of both the '768 patent and the '017 patent are useful only in the showroom display of caskets available for selection prior to purchase and actual use in the viewing and funeral services, not for use in displaying the deceased during a viewing and funeral services.

A simple casket cylinder or pedestal design, including a stabilizer device therefor, is disclosed in U.S. Pat. No. 5,197,169, issued Mar. 30, 1993 ("the '169 patent"). The '169 patent describes two slotted, interlocking plastic sheets, joined together at right angles by interlocking the slots to form a cylinder or pedestal for supporting a casket, and a stabilizer to maintain the sheets in a right-angle relationship. This creates a simple and easy-to-transport casket-supporting device, but does not otherwise provide an enhanced display for the viewing and funeral services. Another relatively simple cylinder or pedestal device for supporting a casket is disclosed in U.S. Pat. No. Des. 257,183, issued Sep. 30, 1980 ("the '183 patent"). As with the '169 patent, the '183 patent does not include an enhanced display for the viewing and funeral services.

None of the previously known casket display systems provide a casket display system having a bier comprising cylinders for supporting the casket and a back wall attached to and mounted upon the cylinders by a supporting device in which the cylinders support the supporting device, all of which is easily transportable and amenable to quick assembly and disassembly.

SUMMARY OF THE INVENTION

The present invention provides a display system for a casket, both for a casket displayed prior to selection, e.g., in a showroom prior to purchase, and for a casket in actual use, e.g., in a viewing room and/or during a funeral or memorial service. The casket display system of the present invention is easy to assemble in a short period of time and the component parts are lightweight enough for a single human to be able to lift and move about for assembly. The assembled casket display system is strong and sturdy and gives the appearance of stability and mass, and when the component parts are packaged in an assembly kit, it is easily transportable. The casket display system of the present invention comprises a back wall panel, a plurality of casket-supporting cylinders, and at least one supporting member, in which each supporting member is supported by at least one of the cylinders and provides support for the back wall panel. Preferably the back wall is completely supported by the supporting members, and requires no additional provision of support. Each supporting member may be attached to two of the cylinders. Preferably each supporting member is attached to one cylinder, and the cylinder to which the supporting member is attached is connected by a connecting member to a second cylinder. The cylinders may be interconnected by the connecting member, to provide enhanced support to the back wall supporting member and stability to the entire casket display system.

One object of the present invention is to provide for the display of a deceased human body in a casket supported by an easy-to-assemble plurality of cylinders, which includes a back wall upon which items, such as signs relating to the casket when offered for sale or various memorabilia relating to the deceased person, may be displayed. In addition to the back wall, one or more side or wing walls may be mounted on the ends of the back wall for display of additional items and to form an alcove about the casket.

Another object of the present invention is to provide a casket display system which may be easily assembled, easily disassembled and easily transported, and which is lightweight yet stable. The components of the casket display system are all preferably lightweight. Thus, the cylinders are preferably tubular and made of a lightweight material such as wood, fiberwood or a polymer, and which may be corrugated or solid. The back wall panel is preferably hinged so that it can be collapsed accordion-style into a smaller size for ease and convenience of transport. If wing wall sections are employed, these are removable, and preferably are hingedly removable. The supporting members are preferably formed from a lightweight tubular steel material, but may also be formed from another lightweight tubular material, or from a lightweight, flat strip-like material or a solid rod-like material. Such alternative materials may include, without limitation, steel, other metals, and polymeric materials with or without fiber reinforcement.

Another object of the present invention is to provide a casket display system which is tastefully designed and coordinated, and in which the exact design, colors, surface texture and particular memorabilia used may be easily changed and customized for each use of the casket display system. Thus, for example, each cylinder may be provided with a removable sleeve as its outer covering, rather than having a single permanently applied and attached outer surface. The removable sleeve allows the appearance of the cylinders to be changed to match that of the casket which rests upon the cylinders. The cylinders thus may preferably have an outer shell appearing as a wood grain, fabric or metallic surface. As another example of the possible variations in using this casket display system, the outer covering of the back panel and any wing panels may be changed to provide various differently colored backdrops for the casket, and the color of the backdrop may thus be selected to match or coordinate with the colors of the casket or its appointments.

A further object of this invention is to provide an assembly kit for a casket display system, in which all of the components of the casket display system are provided in an easily transportable size, and in which the components of the casket display system are easily assembled by a single human in a short time.

DETAILED DESCRIPTION OF THE INVENTION

Figure 1:
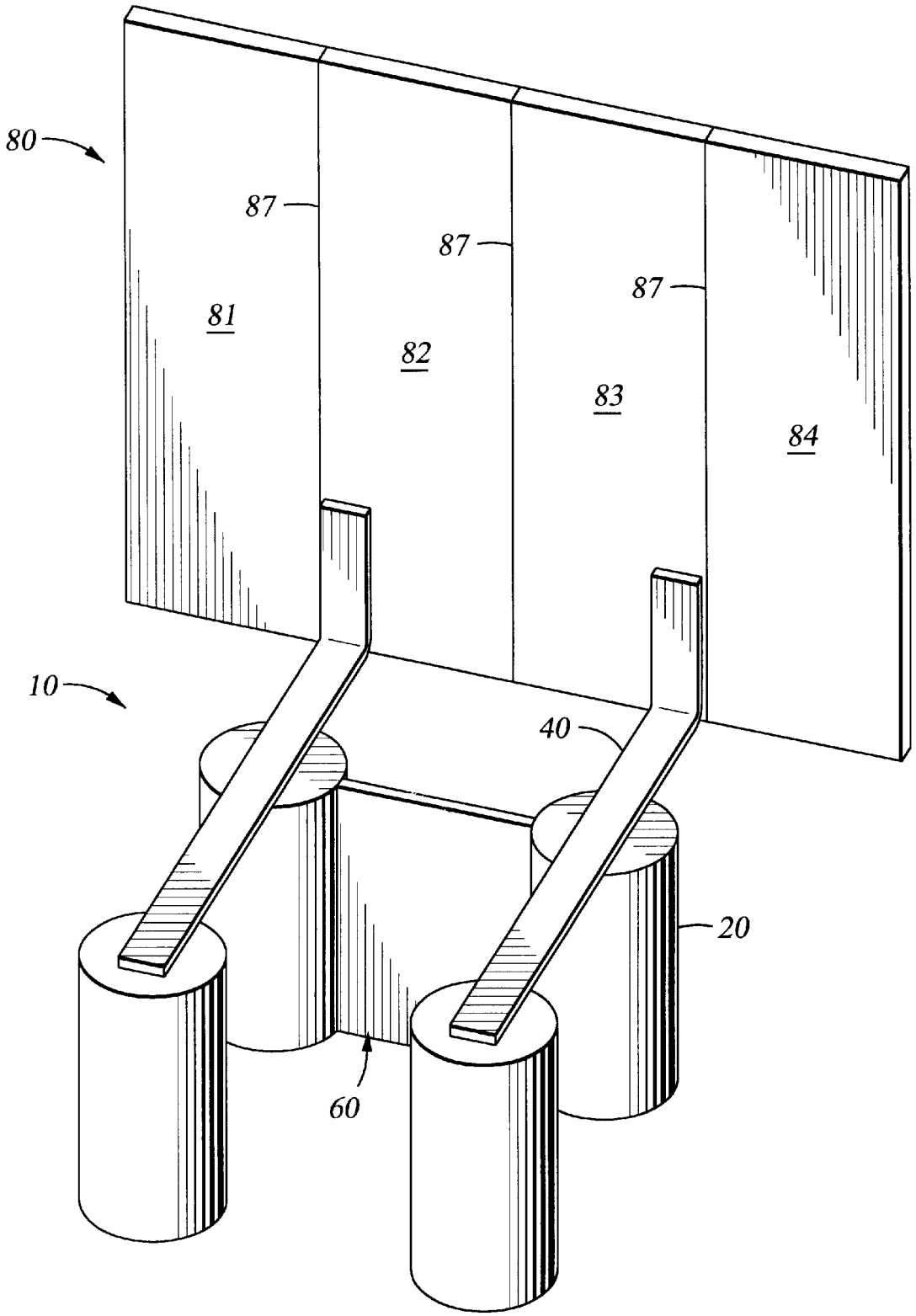
FIG. 1 is a perspective drawing of one embodiment of a casket display system in accordance with the invention.
Figure 2:
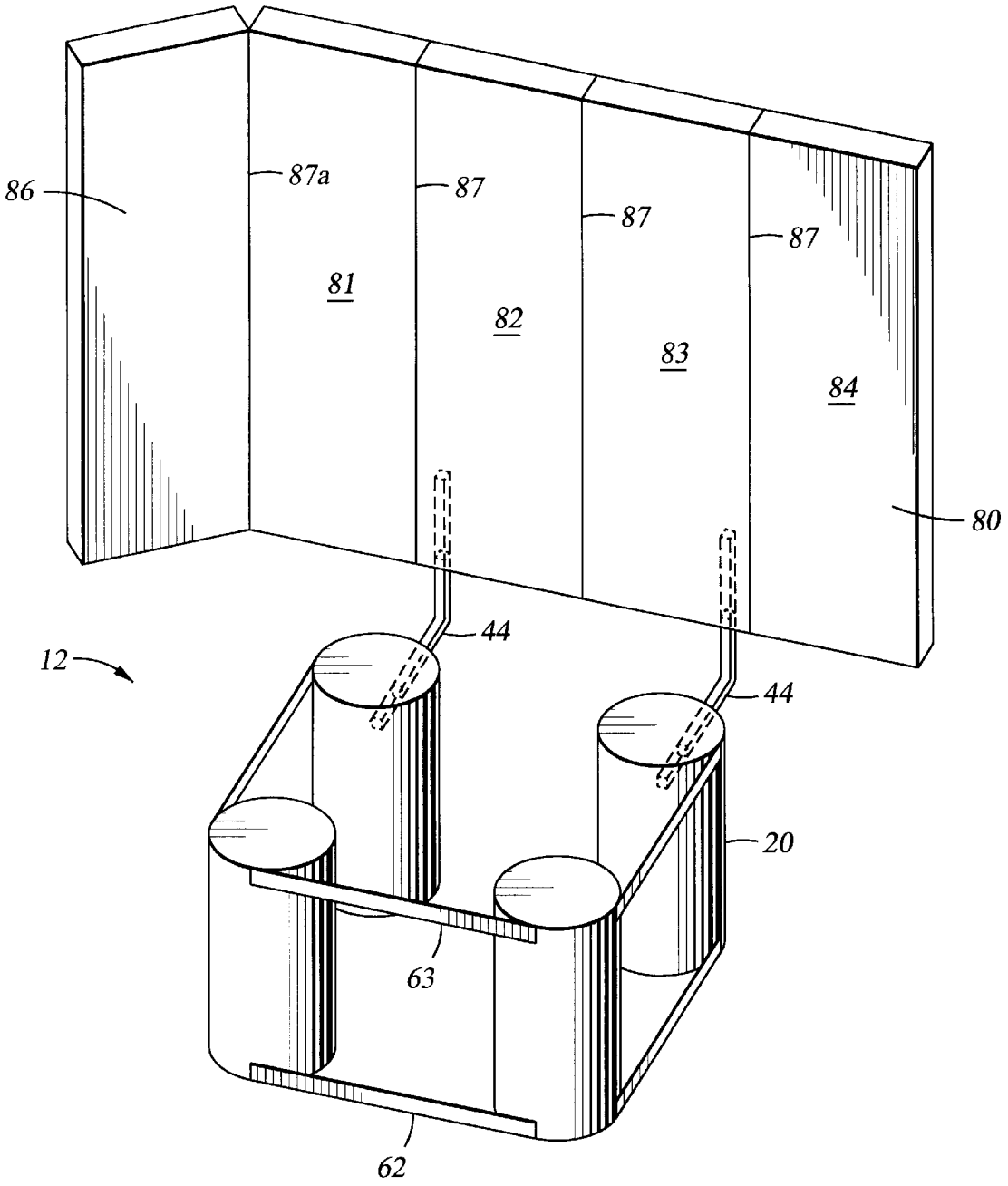
FIG. 2 is a perspective drawing of another embodiment of a casket display system in accordance with the invention.

With reference to FIGS. 1 and 2, the casket display system 10, 12 of the present invention comprises a vertical foldable back wall panel 80, a plurality of casket-supporting cylinders 20, at least one supporting member 40 supported by at least one of the plurality of cylinders 20 for supporting the back wall panel 80. The casket display system 10, 12 may include one or more connecting members 60 for connecting two or more cylinders 20 together, for providing added stability to the casket display system and stronger support to the back wall panel 80. The cylinders 20 and the connecting members 60, when assembled together, form a bier upon which a casket may be supported. The bier thus formed may be combined with the supporting members 40 and the back wall panel 80 to form the casket display system of the present invention.

The back wall panel may be a lightweight but relatively stiff material, such as fiberwood, plywood or a synthetic plastic material such as plexiglass or Mylar. The back wall panel material may be corrugated. The back wall panel 80 may be covered with a fabric-like material or have a similar textured surface. In one embodiment, the fabric-like material is removably attached to the panel allowing the user to select the color of the back wall panel. Preferably the back wall panel 80 includes known means for removably attaching objects such as signs, photographs, flower arrangements, and other objects, e.g., memorabilia of a deceased person for whom the casket is used. Signs and other objects related to selection of the casket may also be displayed on the back wall panel prior to selection and purchase of a displayed casket in a showroom. The means for attaching objects includes, e.g., peg-board type, hook-and-loop fabric (e.g., VELCRO®), magnetic, tackable surface or electrostatic surface attachments or other known devices for removably attaching objects to a vertical surface for display thereon.

Figure 20:
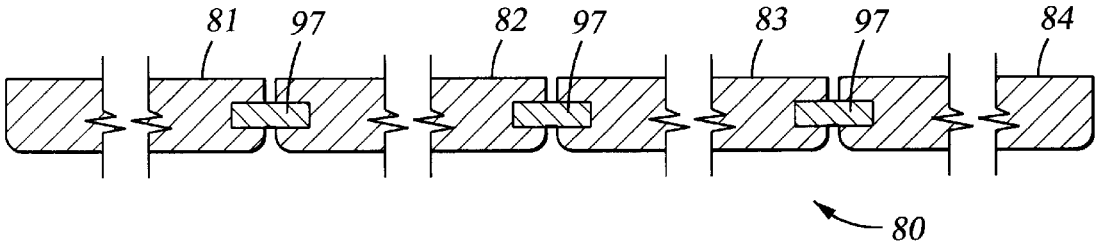
FIG. 20 is a cross-sectional view of an embodiment of the back wall panel including splines between sections of the back wall panel, in accordance with an embodiment of the invention.
Figure 22:
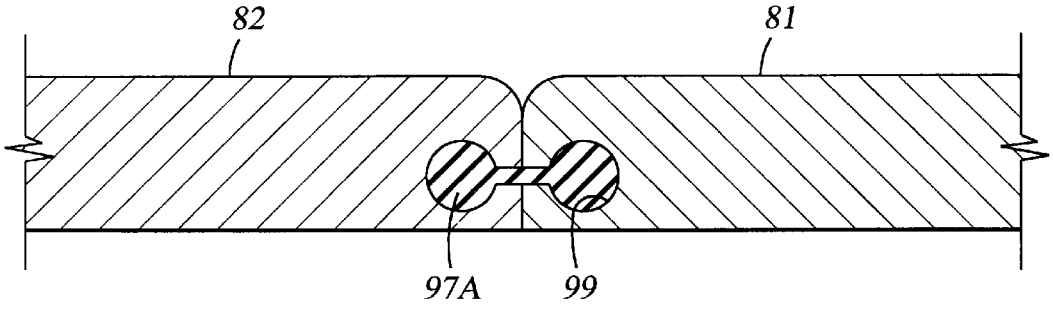
FIG. 22 is a cross-sectional view of a preferred embodiment of a cylinder including an end panel in accordance with the invention.
Figure 10:
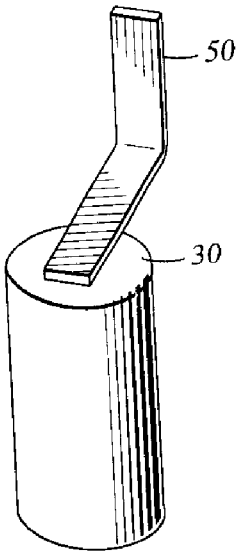
Figure 11:
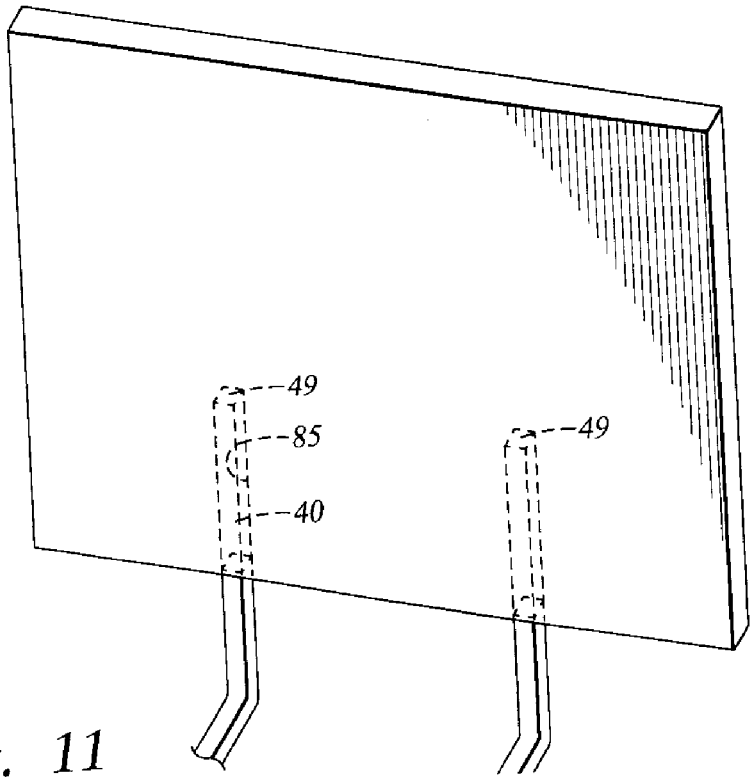
Figure 22:
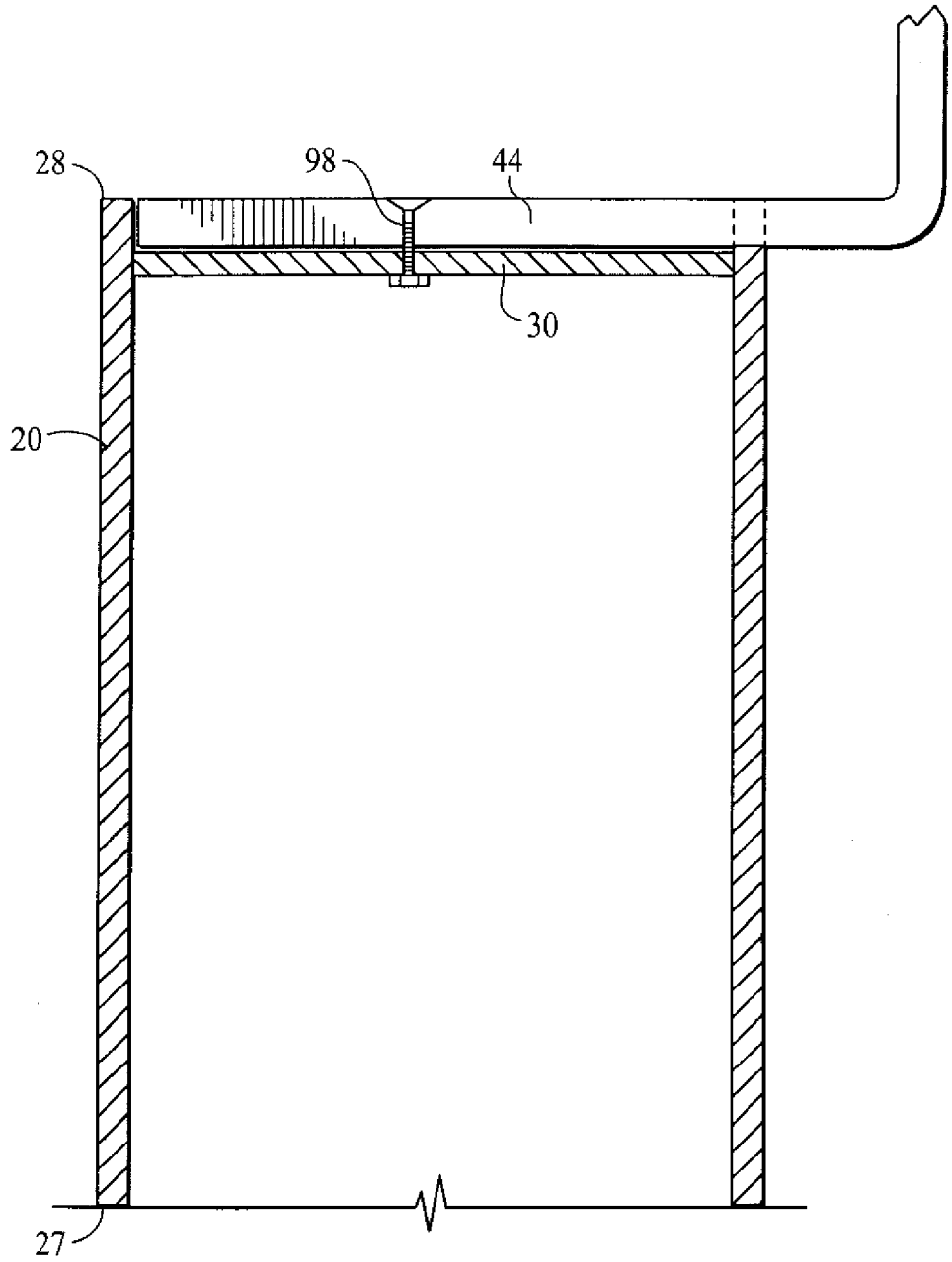
Figure 20:
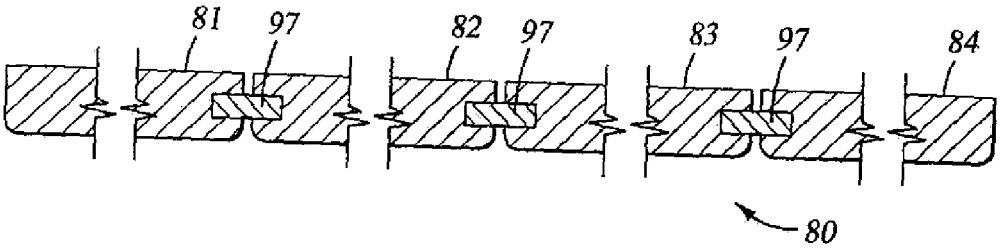
Figure 21:
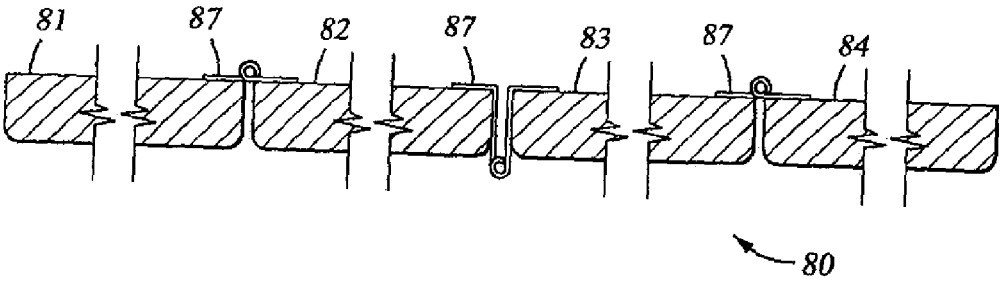

The back wall panel 80 preferably comprises several separate sections, which are interlocked together for mounting. Preferably the sections have splines 97, 97*a* providing a tongue-and-groove type interlock. The preferred spline 97 is rigid, such as a wood strip, as shown in FIG. 20. The preferred spline 97 interlock allows the sections of the back wall panel to be maintained in alignment with each other to form a relatively flat back wall panel. An alternative spline is flexible, and allows some rotation about the splined joint while maintaining the connection between sections, as shown in FIG. 22. The flexible spline 97*a* is preferably made of an extruded resilient material such as a neoprene, a coploymerized or modified polyethylene, or other rubber-like material which is flexible, resilient and strong. The flexible spline 97*a* is preferably retained in a routed keyhole slot 99. Although the flexible spline 97*a* is shown having a round shape and fitting into a matching round slot 99, the spline may have any shape consistent with its retention in the slot 99. In a more preferred embodiment, utilizing the rigid spline 97 interlock, the back wall panel 80 includes four vertically interlocking sections 81, 82, 83, 84, connected together by three spline joints 97 as shown in FIG. 20. This construction allows the four sections to be disconnected and stacked together for storage or shipment. Most preferably, each of the four sections 81, 82, 83, 84 has a height of about four feet and a width of about two feet. Thus, the preferred back wall panel 80 has an assembled, in-use width of about eight feet and a height of about four feet.

Figure 21:
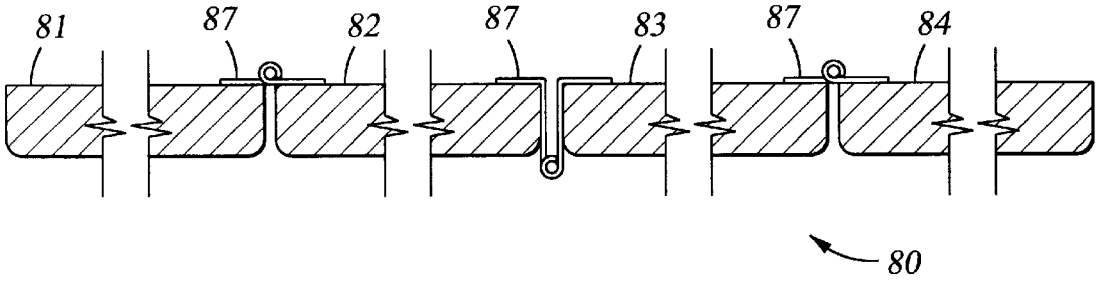
FIG. 21 is a cross-sectional view of an embodiment of the back wall panel including hinges between sections of the back wall panel, in accordance with another embodiment of the invention.

The back wall panel 80 may be foldable and may include at least two vertically aligned sections attached together by a set of hinges 87. The hinges allow the panel to be folded about the hinges in an accordion-like fashion, to reduce the overall size of the panel for transport or for storage. Preferably the hinges are designed for easy separation of the panels, such as by use of removably interlocking hinges. Preferably the hinges are mounted so as to not be visible to those viewing the casket display from the front while the casket display system is in use, e.g., in a funeral service, although as shown in FIG. 21, the central hinge may be visible. In the hinged embodiment, shown in FIGS. 1 and 2 and in cross-section in FIG. 21, the back wall panel 80 preferably includes four vertically hinged sections, 81, 82, 83, 84 attached together by three sets of hinges 87, which allows the panel to be folded in an accordion-like fashion, so as to reduce the overall size of the panel even further than with fewer panels and associated hinges. Preferably each of the four hinged sections has a height of about four feet and a width of about two feet, with a set of hinges 87 disposed between each four feet high, two feet wide section. Thus, the preferred unfolded back wall panel 80, assembled and open for use, has a total width of about eight feet, and a height of about four feet. In this most preferred embodiment the sections of the panel are foldable about each set of hinges, which allows the panel to attain a much smaller size, i.e., it still has a height of about four feet, but only has a width of about two feet when folded.

Other arrangements of back wall panel sections could be used, with a larger or smaller back wall panel, and a greater or lesser number of sections and with either a set of hinges, a spline interlock, a tongue and groove joint, or some other type of attachment allowing a reduction in size of the back wall panel for storage or shipment. In any case, the number of panels will generally be one greater than the number of sets of hinges, spline interlocks, tongue and groove joints, or other attachment means, since each attachment means is disposed between two panel sections.

The lower edge of the back wall panel is at approximately the same height above the floor as is the top of the preferred cylinders. In the preferred embodiments of the present invention shown in FIGS. 1 and 2, the cylinders 20 are approximately 24 inches high, which in turn causes the lower edge of the back wall panel 80 to be disposed at a height of approximately 24 inches above the floor. This is the most preferred embodiment of the cylinders, together with the preferred embodiment of the back wall panel disclosed above, the total height above the floor of the upper edge of the back wall panel is approximately 72 inches, the back wall panel 80 preferably having a height of about 48 inches.

As exemplified in FIG. 2, in addition to the back wall panels described above, the present invention may also include side wall panels, or "wings" 86. One such side wall panel 86 is shown in FIG. 2. Such side wall panels 86, if used, may be hingedly and removably attached to the ends of the back wall panel 80 by means of a hinge 87*a*, similar to the hinges 87 used to hingedly attach the back wall panel sections 81, 82, 83, 84 together. In use the side wall panels 86 may be arranged so as to be at any selected angle with respect to the back wall panel, most preferably at a right angle, or a slightly obtuse angle, so as to form an alcove about the casket on display in the casket display system 10 of the invention. The side wall panels 86 may be attached by other devices, such as gravity interlock devices. Such an embodiment may have a limited range of motion and a correspondingly limited number of positions relative to the back wall panel 80. In another embodiment, the side wall panels 86 may be attached by removably interlocking hinges, which would provide a wider range of motion.

One or two side wall panels may be used, depending on the needs of the user. The side wall panels 86 may also be foldable in an accordion-like fashion in the same manner as the preferred back wall panel 80. The preferred side wall panels 86 may be removed from the back wall panel sections to which they are hingedly attached, or the side wall panels may be folded in an accordion-like fashion at the hinges 87*a* along with the back wall panel 80. The dimensions of the side wall panel 86 are preferably the same as the dimensions of each of the back wall panel sections 81, 82, 83 and 84. Thus, the preferred side wall panel 86 conforms to the dimensions of the preferred back wall panel sections.

Figure 14:
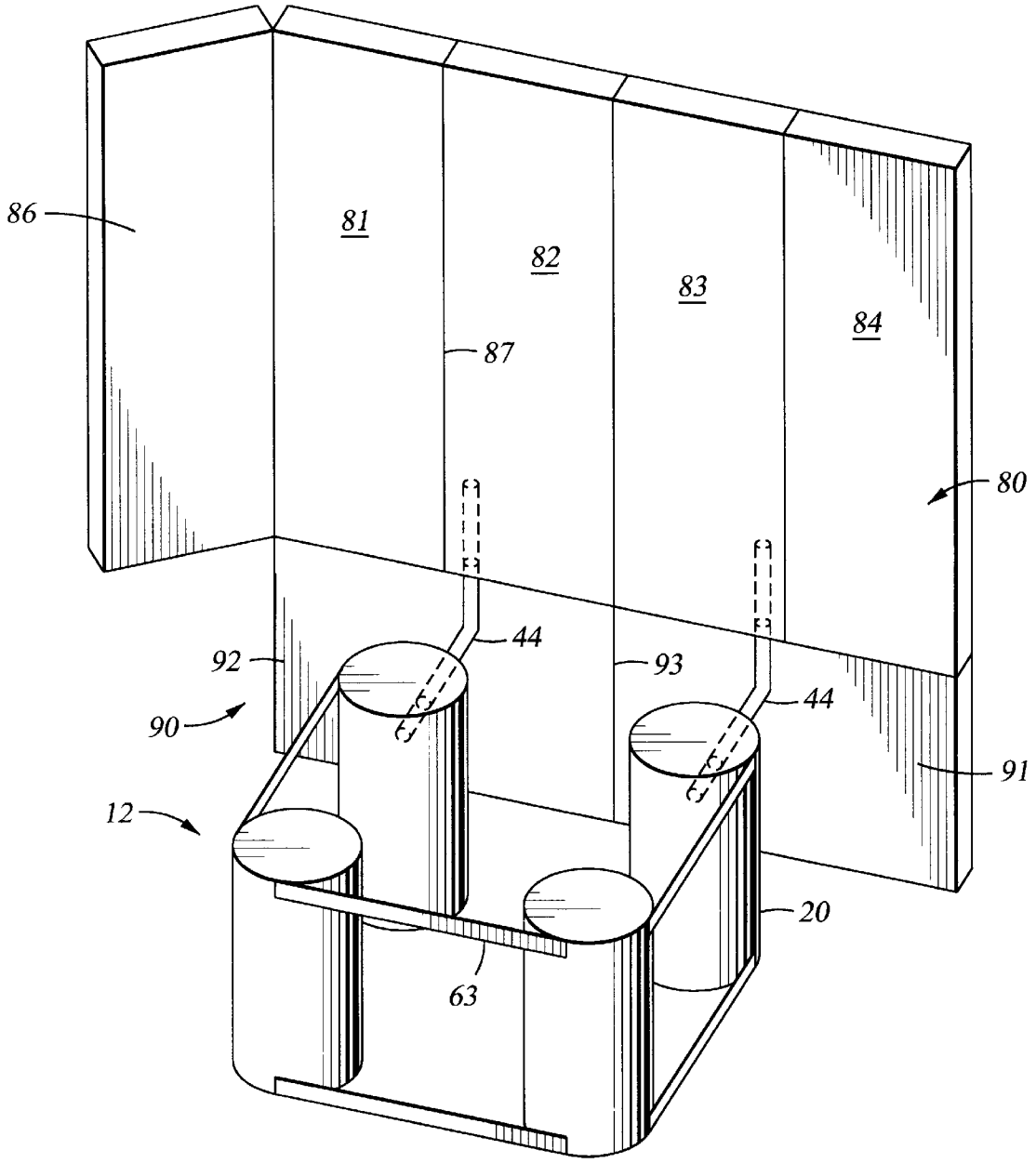
FIG. 14 is a perspective view of another embodiment of the casket display system in accordance with the invention, including a lower back wall panel.

In addition to the back wall panel 80 and side wall panel 86 described above, the present invention may also include a second, lower back wall panel 90, which may be disposed directly below the original back wall panel, as shown in FIG. 14. As described above, the most preferred embodiment of the invention, the lower edge of the back wall panel 80 is preferably about two feet above the floor, leaving a gap of about two feet between the back wall panel 80 and the floor. The lower back wall panel 90, shown in FIG. 14, may be used to fill this gap, and may be made from two sections 91 and 92, each preferably measuring four feet by two feet. As suggested by FIG. 14, these sections 91, 92 may preferably be hinged together and foldable about an axis 93 formed by the two feet wide joint between the sections 91, 92, and may be hung on the lower edge of the back wall panel 80, or may rest direction on the floor.

Each cylinder 20 of the casket display system 10 preferably has a sufficiently low weight to enable hand transport by a single human. Preferably, every individual component part of the casket display assembly is sufficiently lightweight that a single human can easily manipulate and assemble the component parts to form the casket display system. The cylinders 20 are strong enough that the plurality used to form the bier in the casket display system 10 of the invention provides complete, stable support for a casket supported on those cylinders 20. Likewise, the cylinders 20 have strength sufficient to provide support to the supporting members 40 which hold in place the back wall panel 80. Preferably, the cylinders 20 provide complete support required to enable the supporting members 40 to provide complete support to the back wall panel 80. The term, complete support, as used in this specification, means that no other support is required to maintain the supported member in its place. Thus, the cylinders 20 preferably provide complete support to the casket, and no other apparatus is required to stably support the casket. Likewise, the cylinders 20, with their connection or attachment to the supporting members 60 as described more fully below, preferably provide complete support to the supporting members 40, which in turn preferably provide complete support to the back wall panel 80.

Figure 3:
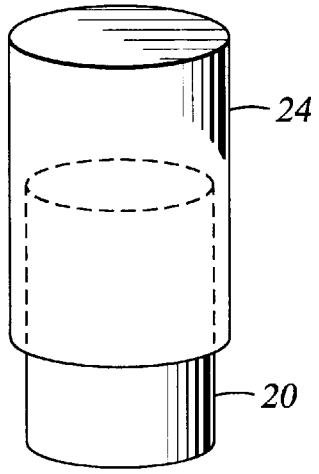
FIG. 3 is a is a perspective view of a cylinder and an outer shell in accordance with the invention.

As shown in FIG. 3, each cylinder 20 preferably also includes a removable outer shell or covering 24, which is separate from the inner, support-providing portion of the cylinder 20. Preferably a number of different outer shells 24 may be interchangeably used, thus giving the cylinder a selectable appearance to match or complement a casket supported on the cylinder. Thus, the texture, color, material or other feature related to the appearance of the surface of the outer shell 24 may be selected by the user. For example, the outer shell 24 may have a wood grain appearance, a metallic appearance, it may be smooth and shiny or textured and without a gloss. Most preferably, a matching or complimentary outer shell 24 would be available for each casket outer surface.

Figure 4:
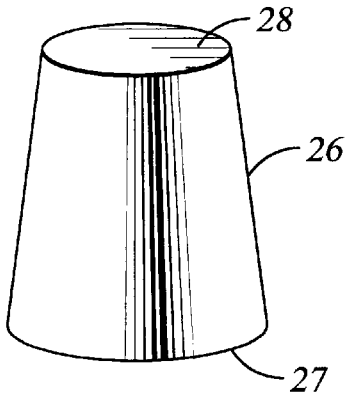
FIG. 4 is a is a perspective view of another embodiment of a cylinder in accordance with the invention.

The cylinder 20 may have any shape, but is preferably cylindrical. As shown in FIG. 4, the cylinder may also, for example, have a frustoconical shape 26. In this frustoconical embodiment, the lower, floor-contacting end 27 of the cylinder may have a larger diameter than the upper, casket-contacting end 28 of the cylinder 26, which may provide enhanced stability or aesthetic beauty. The frustoconical embodiment could also be inverted, with the larger end up. Whatever the outer shape of the cylinder, it is preferably tubular, with a hollow interior, thereby providing the maximum strength for a given overall weight of the cylinder. The cylinder may be made of plywood, fiberwood, or a fiber reinforced material, and may be corrugated. The cylinder may be as simple as a length of PVC pipe having, e.g., an eight inch diameter, covered by an outer shell or sleeve 24 made from plastic, metal, fabric or fabric-like sheeting and coated to obtain the selected appearance. The fabric or fabric-like surface may comprise a woven fabric or a sprayed-on fabric-like material giving the appearance of fabric. Alternatively, the cylinder could, for another example, have the rhombohedral shape of the cylinders shown in U.S. Pat. No. Des. 257,183; the cylinder could be square in cross section; or it could have some other shape. The cylinder 20 itself or the outer shell 24 may have an appearance similar to that of classical columns, such as Doric, Corinthian, Ionic or other similar styles or motifs which are often used in funeral industry architecture and appointments. The cylinder may include any modular vertically extending device which can form a bier to support a casket and provide support to one or more supporting members, where the supporting members are used to support the back wall panel 80 as described herein. In accordance with the invention, a bier may be formed by attaching together a plurality of sheets or panels of approximately the vertical height shown for the cylinder 20, i.e., two feet. The bier may comprise, e.g., four such panels connected end to end at right angles to one another, forming a box. In such an embodiment, the cylinders and the connecting members would essentially merge into a single box-like device forming a bier for supporting a casket and providing support to a back wall panel, the bier being approximately two feet high. In this embodiment, the casket display system comprises a back wall panel, a bier, and at least one supporting member supported by the bier and providing support for the back wall panel.

Referring again to FIGS. 1 and 2, preferably the casket display system 10 of the present invention also includes at least one connecting member 60, 62 and/or 63, which connects together the cylinders 20 to provide enhanced stability to the casket display system and enhanced support to the back wall panel 80. Each connecting member 60 would connect together preferably two cylinders 20, although more could be connected together by a single connecting member. More than one connecting member may be used to connect two or more cylinders, as shown by reference numbers 62 and 63 in FIG. 2. The connecting member 60 preferably provides indirect assistance in supporting the supporting member 40 used to support the back wall panel 80, by virtue of the fact that the cylinders are thereby connected and made more stable as a group.

Figure 5:
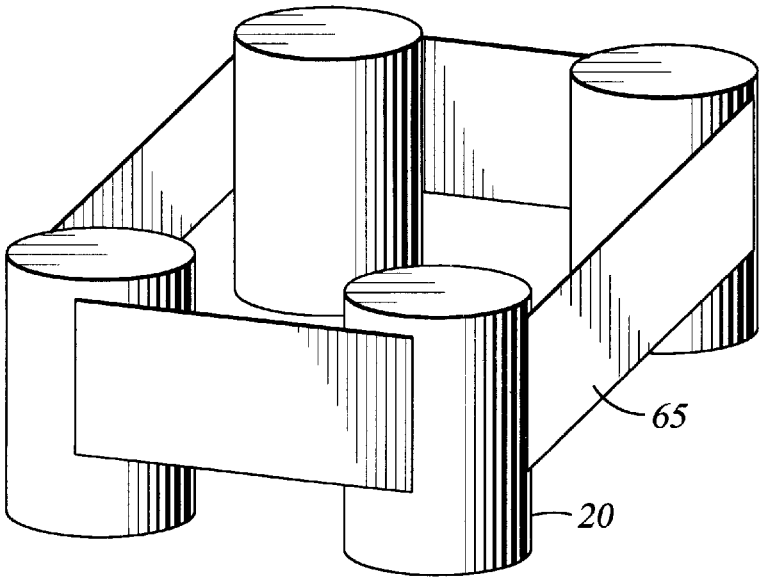
FIG. 5 is a perspective view of a bier formed by four cylinders and connecting members, in accordance with an embodiment of the invention.
Figure 6:
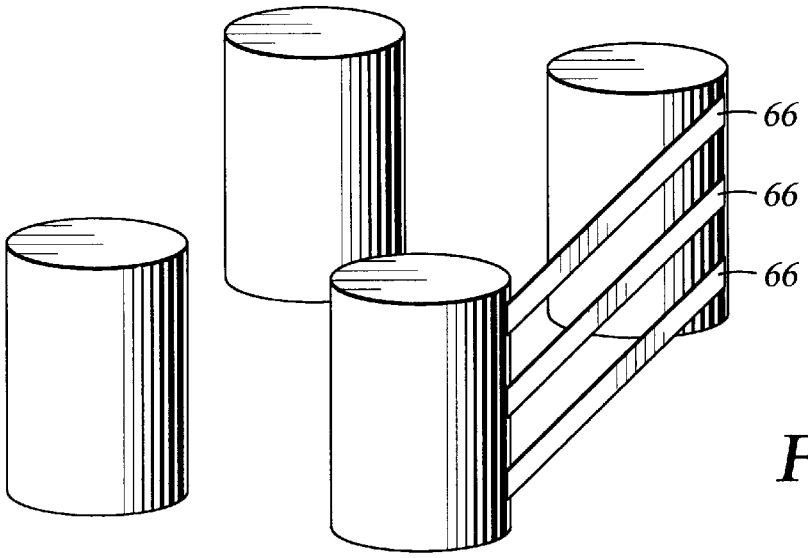
FIG. 6 is a perspective view of a bier formed by four cylinders and connecting members, in accordance with another embodiment of the invention.
Figure 7:
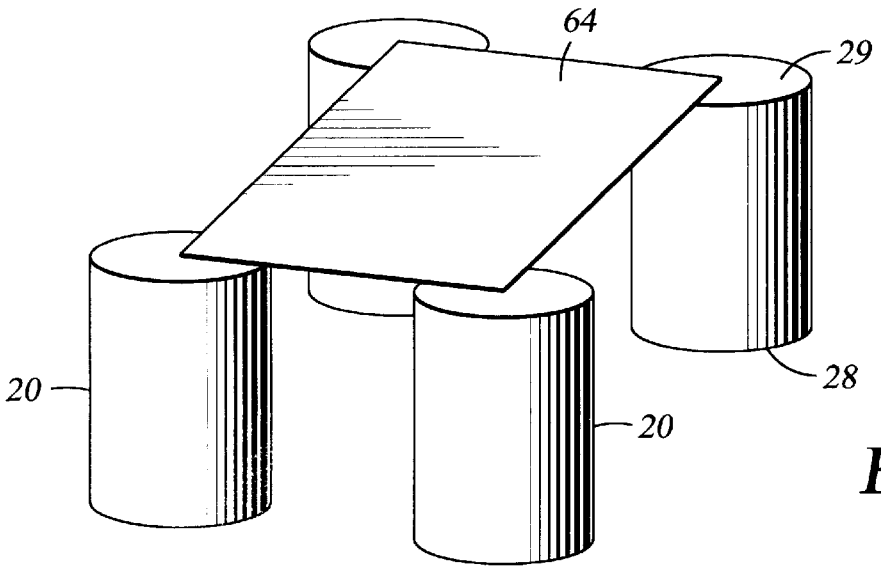
FIG. 7 is a perspective view of a bier formed by four cylinders and a connecting member, in accordance with another embodiment of the invention.

The connecting member may have any configuration, from a simple bar or rod 62 running from one cylinder to an adjacent cylinder as shown in FIG. 2, to a flattened strip-like band, to a solid sheet 60 attached or touching each cylinder from the bottom to the top of the cylinder, i.e., from the floor to the casket as shown in FIG. 1, or any lesser portion of the distance between the floor and the casket, as shown by a partial sheet 65 in FIG. 5. The connecting members may be attached to each of the adjacent cylinders at multiple locations along the vertical height of the cylinder, as shown, e.g., by the three connecting members 66 in FIG. 6. The connecting member may be positioned along the side of the cylinders 20 as shown in FIGS. 1, 2, 5 and 6 or may be positioned on the floor beneath the bottom end 28 of the cylinder, or adjacent the top end 29 of the cylinder as shown in FIG. 7, or as described in more detail below for the embodiment shown in FIGS. 15–17. FIG. 7 shows a square sheet 64 as the connecting member, connecting all four cylinders shown. The actual connecting member used in an embodiment may comprise strip-like members, arranged in a connected or unconnected square, and less than all of the cylinders may be connected to one another by such strips, and various combinations of connecting members may be used simultaneously. Any of the connecting members may be covered or screened by a skirt of fabric. The connecting member may be attached to the cylinder parallel to the tangent (i.e., aligned with the tangent), perpendicular to the tangent (i.e., axially outward from the tangent), or at any angle therebetween.

The connecting members may be attached by various known means, e.g., by a ready-to-assemble ("RTA") fitting, by a threaded screw connection, by a magnetic device, by a hook-and-loop (VELCRO®) attachment, by gravity lock method, or otherwise as known to those in the art. The preferred connecting member is the ready-to-assemble ("RTA") fitting, which includes a threaded fastener such as a machine-threaded screw extending longitudinally outward from the end of the connecting member 60, shown in FIGS. 16 and 17, and attached to a threaded nut or other threaded retaining device. The RTA fitting extends through the wall of the cylinder and is retained by an RTA retaining fitting or nut.

The connecting member may include a solid, variously stiff sheet of material, such as a metal, plywood, fiberwood, particle board, or a plastic such as Plexiglas, polyethylene terephthalate, or MYLAR®, any of which may be solid or corrugated. Alternatively, the connecting member may support a flexible, cloth or cloth-like skirting material suspended in the space between the cylinders. Thus, in such an embodiment, the connecting member provides the strength and stability, and the skirt simply acts to close the opening between cylinders, and perhaps to conceal the cylinders and connecting members. Such a skirting material may be a cloth or cloth-like fabric having various textures or colors, preferably selected to match other casket display system colors, such as those of the casket and the remainder of the casket display system. The skirting material may be mounted on the connecting member in any known way similar to those by which a curtain may be hung, e.g., on rings, on hooks, on a rod inserted through a rod-receiving slot on the curtain, by other attaching devices, such as hook-and-loop (e.g., VELCRO®), magnetically or otherwise. Such a skirting material may completely surround the group of connected cylinders, in which case the outer shell 24 described above would not be needed on each cylinder 20. The skirting material may also be suspended between some or all of the cylinders, and the color, fabric, texture, and other properties of the skirting material may be selected to match or complement the color, fabric, texture, or other properties of the back wall panel material.

Figure 15:
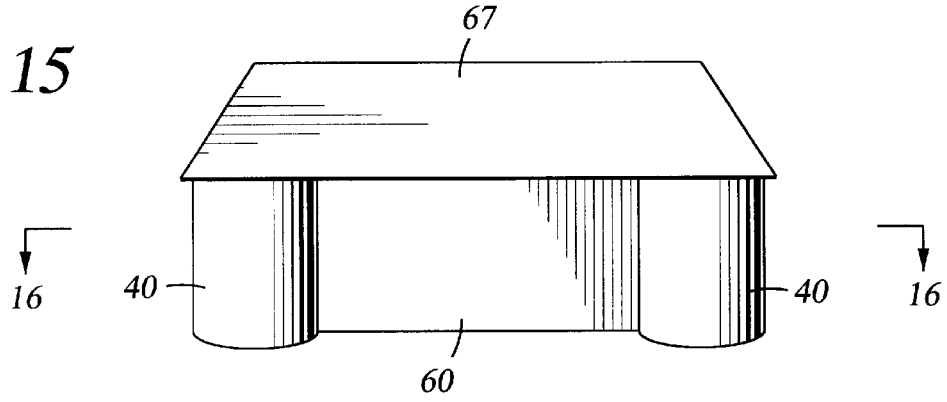
FIG. 15 is a perspective view of the cylinders and connecting members forming a bier in a preferred embodiment in accordance with the invention, also including a platform covering the bier formed by the cylinders and connecting members, upon which the casket may rest.
Figure 16:
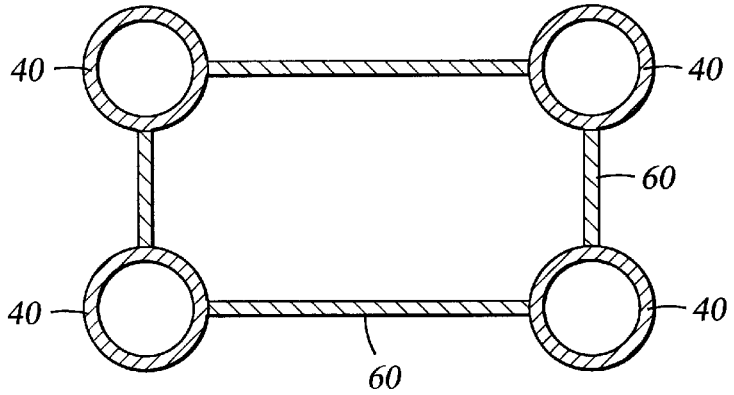
FIG. 16 is a cross-sectional plan view taken at line 16—16 of FIG. 15, and showing the preferred embodiment of the placement of the cylinders and the connecting members, in accordance with another embodiment of the invention.
Figure 17:
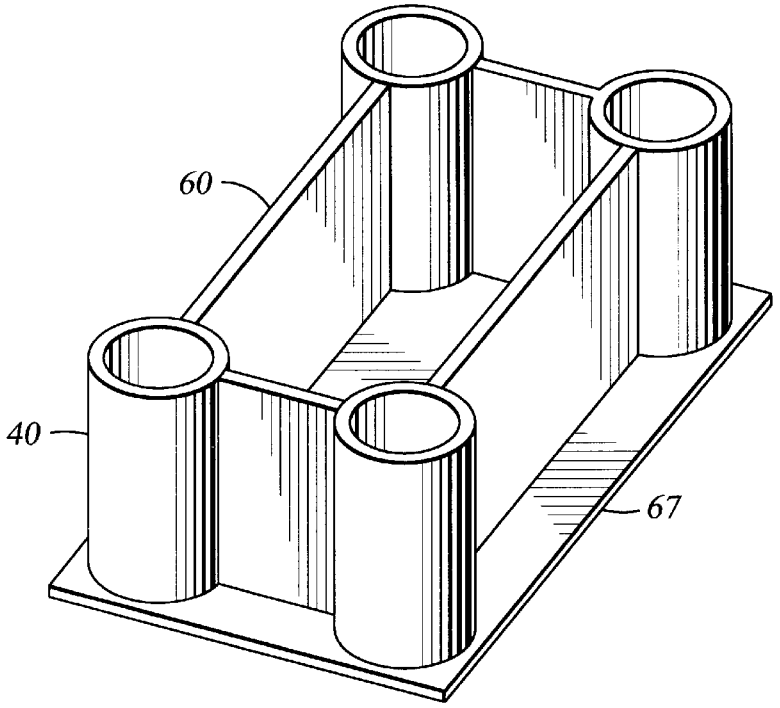
FIG. 17 is a perspective view of the preferred embodiment shown in FIG. 15, in which the bier formed by the assembled cylinders and connecting members, including a covering platform, has been inverted, in accordance with another embodiment of the invention.
Figure 18:
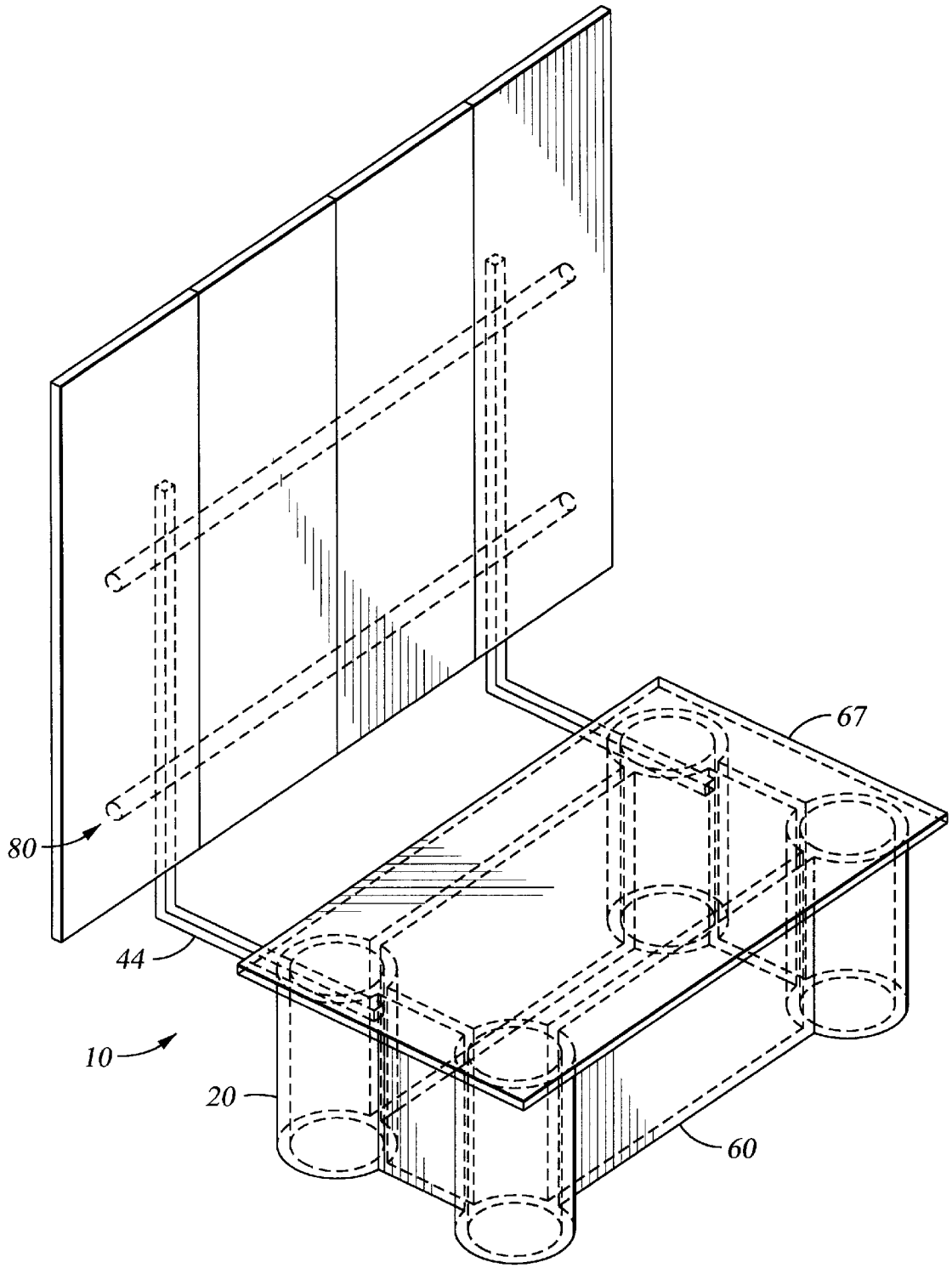
FIG. 18 is a perspective view of the most preferred embodiment of the casket display system of the present invention.

The most preferred embodiment of the arrangement of cylinders and connecting members is best shown in FIGS. 15, 16 and 17. These drawings show an embodiment comprising four cylinders 40 and four connecting members 60, and a platform 67 covering the cylinders and providing a flat resting surface for a casket. The platform 67 may act as the only connecting member, similar to the embodiment shown for the square sheet connecting member 64 in FIG. 7, or the platform 67 may act as a supplemental connecting member working together with the connecting members 60 in FIGS. 15–17, or the platform 67 may act only as a platform, providing a surface between the casket and the bier formed by the cylinders, but having no function as a connecting member. In the preferred embodiment of the cylinders and connecting members as shown in FIGS. 15–17, the platform 67 acts as a supplemental connecting member and extends slightly outward from the cylinders. In this embodiment, the primary connecting members are attached to the cylinders by threaded fasteners, such as machine screws, extending longitudinally outward from the ends of the connecting members, penetrating the walls of the cylinders, and fastened by threaded fasteners, such as nuts. As best shown in FIGS. 16 and 17, in the preferred embodiment, the connecting members are attached perpendicularly to a tangent of the cylinder. The platform 67 in the preferred embodiment is attached to end panels in the cylinders 20, preferably by a threaded fastener such as a machine thread screw and nut.

Figure 8:
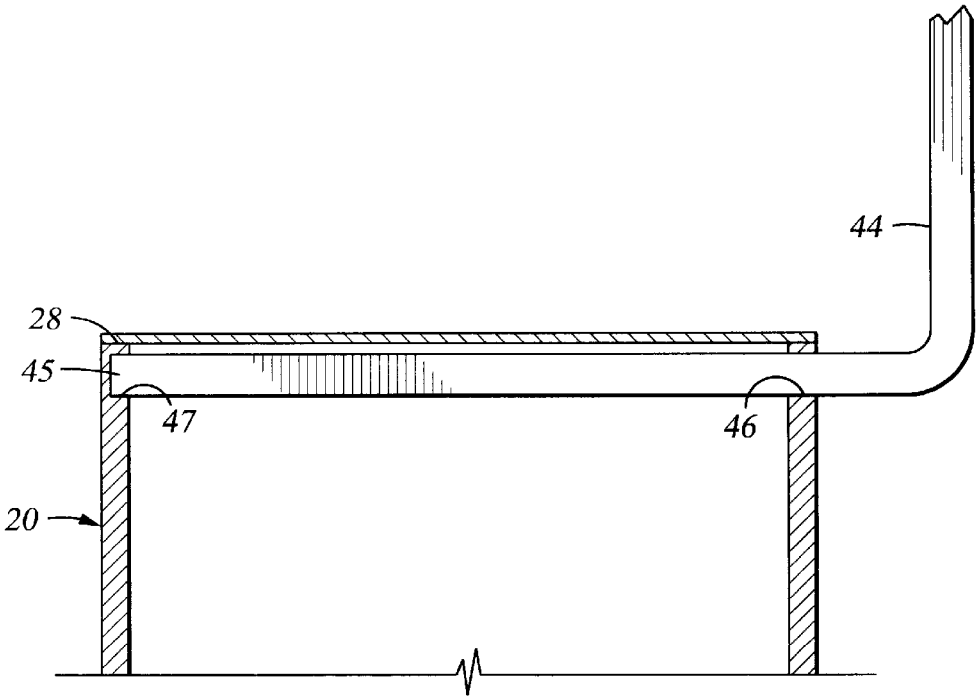
FIG. 8 is a cross-sectional view of a supporting member inserted into a receiving opening and receiving cavity of a cylinder in accordance with an embodiment of the invention.

In a preferred embodiment of the casket display system 10, each supporting member 40 is releasably attached to one cylinder 20 and is releasably attached to the back wall panel 80. As best shown in FIG. 8, in an embodiment in which the supporting member is a tubular member 44, preferably it is a square or rectangular tubular member, and one end 45 of the tubular member 44 is inserted into a tubular wall opening 46. Most preferably the supporting member is a square tubular member. The tubular wall opening 46 extends through the wall of the cylinder 20. On the side of the cylinder opposite the wall opening 46 is located a receiving cavity 47, which is recessed into the wall, and configured to snugly receive the supporting member 44. The receiving cavity 47 preferably does not penetrate through the wall of the cylinder 20, but forms a recess or cavity 47. As an alternative embodiment, the recess or cavity may be formed by a surface-mounted device which includes a receiving cavity. Such a device forms a receiving cavity from its walls or finger-like wall portions extending outward from the inner surface of the cylinder 20. When the end 45 of the supporting member 44 is inserted into the cylinder, it will rest in the surface mounted receiving cavity, rather than into a receiving cavity formed by a recess into the cylinder wall. In either embodiment, the end 45 of the supporting member 44 is received into the opening 46 on one side of the cylinder 20, is passed through the interior of the cylinder to the opposite side, and into the receiving cavity 47. The supporting member may be a tubular member or a solid rod, and may have any outer shape, such as a round, oval, square or other outer shape. The preferred supporting member is tubular, thereby minimizing the weight of the supporting member, and is square, thereby allowing use of inexpensive, readily available materials such as square steel tubing.

Figure 9:
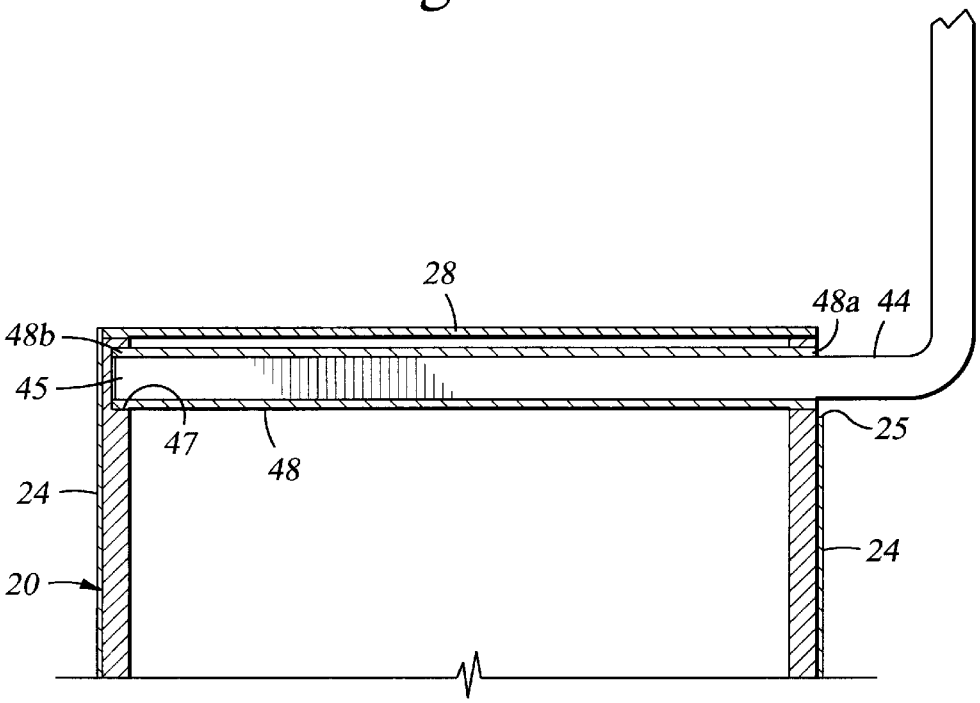
FIG. 9 is a cross-sectional view of a supporting member inserted into a receiving member in a cylinder in accordance with another embodiment of the invention.

Another embodiment includes a tubular receiving member 48 spanning the inner diameter of the cylinder, and having a slightly larger inside dimensions than the outside dimensions of the supporting member, and which may be permanently installed in the cylinder, as shown in FIG. 9. The tubular receiving member 48 may likewise be made of readily available materials, such as square steel tubing or PVC pipe. In the most preferred embodiment as shown in FIG. 9, the supporting member 44 is square in cross-section, and the tubular receiving member 48 is also square in cross-section, and has a slightly larger size so to allow the supporting member 44 to be inserted into the interior of the tubular receiving member 48.

The tubular receiving member 48 as shown in FIG. 9 has an open end 48*a* and a closed end 48*b*. The end 45 of the supporting member 44 is inserted into the open end 48*a* of the tubular receiving member 48 until the end 45 of the supporting member encounters the closed end 48*b* of the tubular receiving member 48 and is received into the receiving cavity 47. Preferably a retaining device is located in the receiving cavity 47 or in the tubular receiving member 48. The retaining device retains the supporting member 44 in position for providing optimum support to the back wall panel 80. The retaining device is preferably a releasable spring-actuated interlocking retaining device.

In an embodiment without a tubular receiving member 48, the cylinder 20 preferably includes an opening for receiving the supporting member and a closed cavity 47, which preferably includes a retaining device for retaining the end 45 of the supporting member. The opening is similar to the open end 48*a*, and the closed cavity is similar to the closed end 48*b*. Preferably a releasable spring-actuated interlocking retaining device, or similar device, is used to retain the supporting member in working position.

Preferably the tubular receiving member or opening and cavity is disposed very near the top end of the cylinder, and the outer shell covering the cylinder includes a notched opening 25 at its upper end, at a location in the outer shell matching the location in the cylinder of the tubular receiving cavity, to accommodate the supporting member 44. In the most preferred embodiment, the notched opening 25 is square, to accommodate the most preferred square supporting member 44. An alternative embodiment includes a tubular member which is rectangular in cross-section, and which may include a tubular receiving member having a matching rectangular cross section. Another alternative embodiment, shown in FIGS. 1 and 10, includes a flat strip-like material used as the supporting member 50. In such an embodiment, which also includes a receiving cavity in the cylinder, the receiving cavity would be a slot-like receiving cavity. The flat strip-like embodiment also may include an appropriately configured tubular receiving member permanently installed in the cylinder.

The preferred cylinder 20 of the present invention is formed of plywood or fiberwood. The preferred cylinder 20 has a diameter of approximately eight inches, and has a wall thickness of about one quarter inch. The preferred cylinder has an open lower, floor-contacting end 27, and, as shown in FIG. 22, a closed top end 28. The closure at the top end 28 is preferably an end panel 30 made of plywood or fiberwood, and is preferably disposed near or at the top end 28 of the cylinder 20. Preferably, in a cylinder to which the preferred supporting member is attached the end panel 30 is recessed to provide a space above the end panel 30 for the supporting member 44. In this preferred embodiment, the upper edge of the top end 28 of the cylinder 20 is approximately flush with the upper surface of the supporting member 44. In this embodiment, the supporting member is preferably attached directly to the end panel 30 by means of a threaded fastener or an RTA device 98. Such an embodiment is shown in FIG. 22. In a cylinder not contacting, attached to, or providing support to a supporting member, the top end panel may be disposed flush with the upper edge of the top end 28. In an alternative embodiment, the cylinder may not include an end panel 30.

Figure 10:
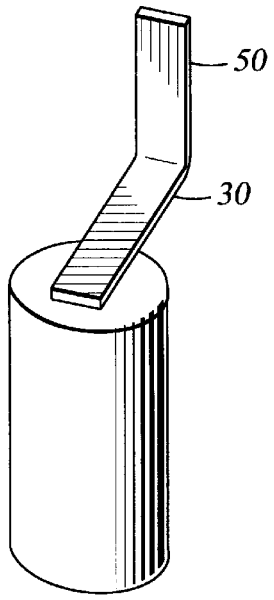
FIG. 10 is a perspective view of a flat, strip-like supporting member resting upon an end of a cylinder, in accordance with another embodiment of the invention.
Figure 11:
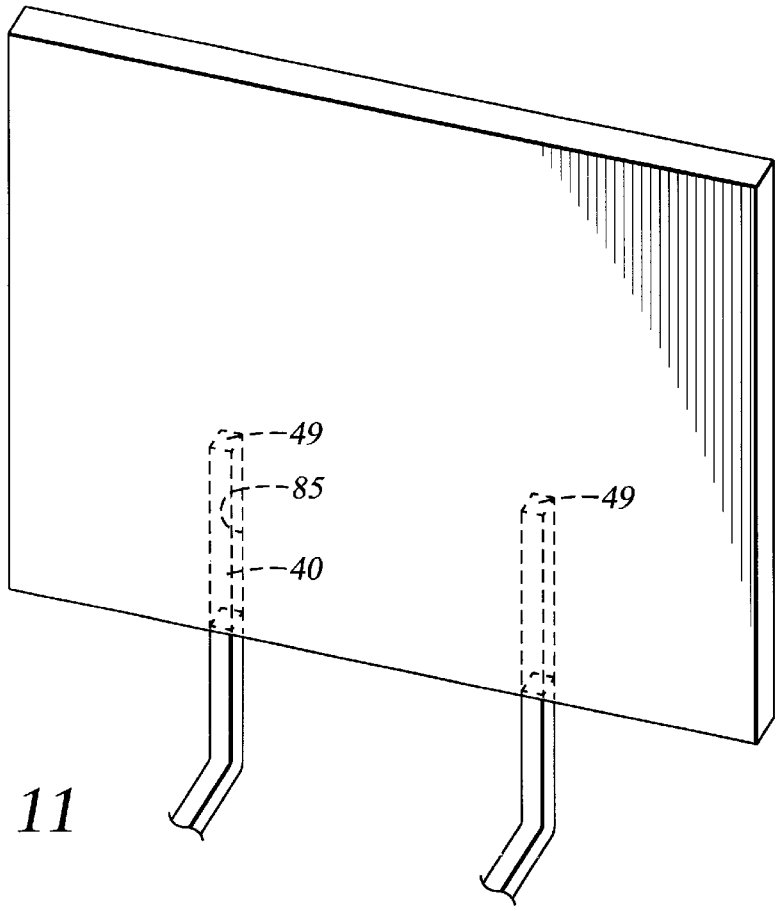
FIG. 11 is a perspective and partial cutaway view of an embodiment having a supporting member inserted into a back wall panel between the front and back surfaces of the back wall panel in accordance with an embodiment of the invention.

As a further alternative, in an embodiment including a flat, strip-like supporting member 50 as shown in FIG. 10, the supporting member may simply rest upon the upper end 30 of the cylinder 20. The cylinder 20 may have either a closed or open end 30. In an embodiment having a flat, strip-like supporting member 50 and a cylinder 20 having a closed end 30, the closed end 30 would be slightly recessed from the upper end 28 of the cylinder 20, to allow sufficient space for the thickness of the supporting member 50. In such an embodiment, the supporting member 50 may simply be retained in place by the weight of the casket bearing down upon it. In such an embodiment, the casket likely would have to be mounted upon the supporting members 50 and the cylinders 20 prior to assembly and mounting of the back wall panel 80, unless some temporary attachment means is used prior to placement of the casket.

Preferably, as shown in FIGS. 1 and 2, the casket display system of the present invention includes two of the supporting members 40 or 44. While a single supporting member may be employed, the casket display system having two supporting members would be more stable than a casket display system including only one supporting member. More than two supporting members may be employed, but the most preferred number is two. Preferably, if a single supporting member connects the cylinders to the back wall panel, the lower end of the supporting member is split and is attached to two or more cylinders, so as to provide sufficient stability to the casket display system.

Figure 12:
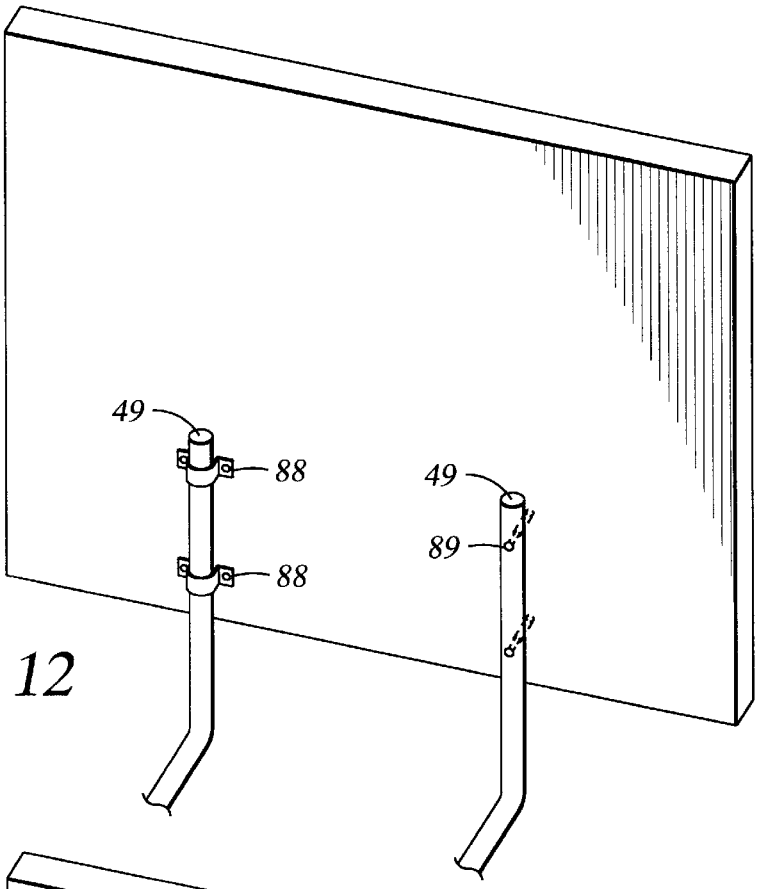
FIG. 12 is a perspective view of an embodiment having a supporting member held in place on the reverse side of a back wall panel by two exemplary devices, in accordance with the invention.

Various embodiments are possible for connecting or attaching the supporting member 40 to the back wall panel 80. In one such embodiment, shown in FIG. 1, the back wall panel has sufficient thickness to allow formation of openings 85 within the thickness of the wall itself, i.e., between the front and back surfaces, the openings 85 having sufficient dimensions to receive the supporting member 40. Such an embodiment may be particularly useful when used with a flat, strip-like supporting member 50, but is also useful for other configurations. Alternatively, as shown in FIG. 12, the supporting member 40 may be attached to the back surface, or non-viewing side, of the back wall panel 80 by known fastening devices, such as a strap or bracket 88, a through-bolt 89, either threaded or equipped with other stopping devices, by an RTA fitting or by other known fastening devices used to attach a member such as the supporting member 40 to a flat surface such as the back wall panel 80. Preferably, the supports are retained in position so that the ends 49 of the supporting members cannot move laterally. Such restriction of movement prevents rotation of the supporting member about the axis penetrating or resting upon the cylinder, and thereby provides for a stable support of the back wall panel.

Figure 13:
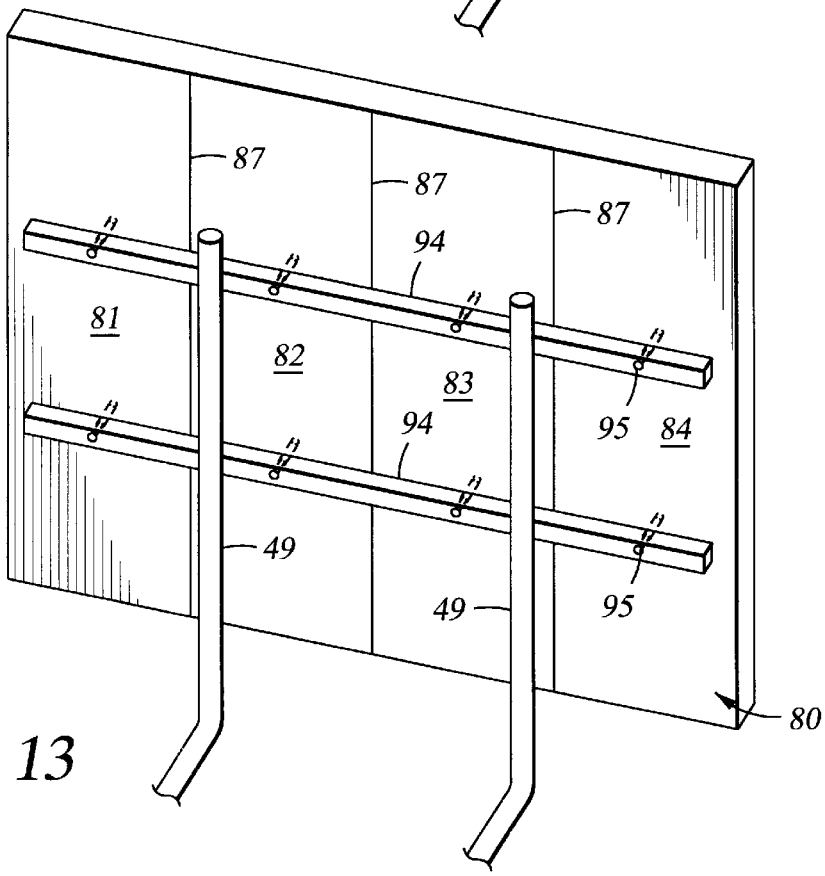
FIG. 13 is a perspective view of a preferred embodiment having a supporting member held in place on the reverse side of a back wall panel by two supporting members and two back wall panel attaching members.

As shown in FIG. 13, the most preferred embodiment of the back wall panel attachment comprises two supporting members 49 and preferably two laterally extending attaching members 94. The casket display system may include only one laterally extending attaching member 94, but two such members should provide enhanced stability. In the preferred embodiment of supporting members and attaching members shown in FIG. 13, the back wall panel 80 is fastened to the attaching members by means of threaded screws or RTA fittings extending outwardly from the rear or back surface of the back wall panel 80, and threaded fastening devices such as nuts are used to securely fasten to back wall panel 80 to the attaching members 94. The attaching members 94 are fastened to the supporting members 49 by threaded fasteners such as screws and nuts, or by other known means, such as welding, gravity lock method or other methods known in the art.

Figure 19:
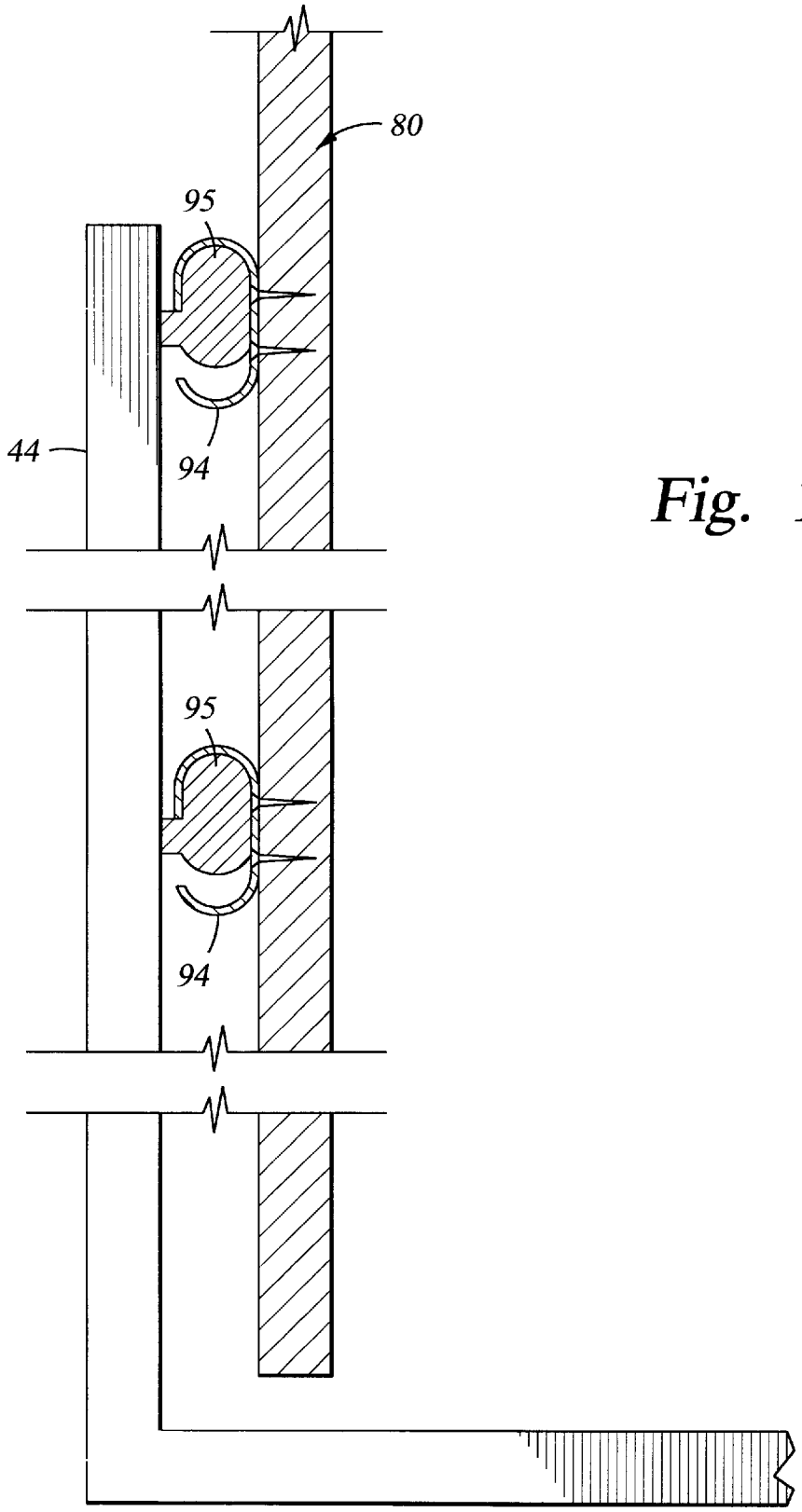
FIG. 19 is a cross-sectional view of the attachment of the back wall panel to the supporting member, and including the attaching member, in accordance with an embodiment of the invention.

As shown in FIG. 19, a cross-sectional view of the back wall panel 80 with the attaching member 94 mounted on the support member 44, the attaching member 94 may preferably rest upon a mounting member 95. The mounting member 95 is attached to the supporting member 44, and is adapted to nest with and support the attaching member 94. The attaching member 94 is preferably a metal channel and is preferably attached by screws to the back wall panel 80. The mounting member 95 is attached to the supporting member 44 preferably by screws. The mounting member 95 is preferably a metal or a sufficiently durable plastic which can withstand the weight of the back wall panel 80 and any memorabilia which may be displayed thereon.

Most preferably, the supporting member or members provide all the support required to maintain the back wall panel in a stable, substantially vertical position. As another embodiment, the supporting members may provide a portion of the support needed by the back wall panel, and the back wall panel may be adapted to receive additional support from some other supporting device. Examples of other supporting devices include the back wall panel of a second casket display system, arranged in back-to-back relation with the casket display system of the present invention. In such an embodiment, the back wall panel of each of the casket display systems receives support from the back wall panel of the other casket display system.

As another alternative embodiment, the back wall panel 80 may receive additional support from a portion of a building in which said structure is disposed. The portion of the building providing such support may be a wall or a column, some device suspended from the ceiling of the building, or some other device for providing support to the back wall panel 80.

In another embodiment of the casket display system, the supporting members extend completely through a first cylinder and into a second cylinder, and may pass through a tubular receiving member in the first cylinder and into another tubular receiving member in the second cylinder. In such an embodiment, the tubular receiving member in the second cylinder are substantially similar to that shown in FIG. 9, and the tubular receiving member in the first cylinder is similar to that shown in FIG. 9, except that both ends of the first cylinder in this embodiment are open, as are the open ends 48*a* in FIG. 9. In this embodiment, the supporting member may also be the connecting member, since the supporting member thus connects together the cylinders 20 to provide enhanced stability to the casket display system and enhanced support to the back wall panel 80.

The present invention may conveniently be packaged as an assembly kit for a casket display system, in which all of the components needed to assemble the casket display system are compactly and conveniently packaged together, for delivery as a unit. Such an assembly kit comprises a back wall panel, as variously described above; a plurality of cylinders adapted to form a bier and support a casket as described above; at least one supporting member adapted to be supported by one or more of the cylinders and further adapted to provide support to the back wall panel. Preferably, the assembly kit includes at least one connecting member adapted for attachment to and forming a connection between at least two of the cylinders, and more preferably for providing additional stability to the casket display system and support for the back wall panel 80.

Having described the invention above, various modifications of the techniques, procedures, material and equipment will be apparent to those in the art. It is intended that all such variations within the scope and spirit of the appended claims be embraced thereby.

What is claimed is:

1. A casket display system comprising a back wall panel, a bier comprising a plurality of cylinders, and at least one supporting member supported by at least one of said cylinders and providing support for the back wall panel.

2. A casket display system as in claim 1, wherein said back wall panel comprises at least two sections.

3. A casket display system as in claim 2, wherein said back wall panel comprises four sections whereby said panel is foldable about hinges in an accordion fashion.

4. A casket display system as in claim 2, wherein said back wall panel comprises spline interlock sections.

5. A casket display system as in claim 3, wherein said back wall panel is about eight feet long and four feet high and each of said sections has a height of about four feet and a width of about two feet, whereby said panel may be reduced in size to attain a height of about four feet and a width of about two feet.

6. A casket display system as in claim 1, wherein each of said plurality of cylinders has a weight small enough for hand transport by a human.

7. A casket display system as in claim 1, wherein said plurality of cylinders provide complete support for a casket supported thereon.

8. A casket display system as in claim 1, wherein each of said cylinders comprises a removable outer shell having an appearance selectable to match or complement a casket supported thereon.

9. A casket display system as in claim 8, wherein said outer shell has a wood grain appearance.

10. A casket display system as in claim 8, wherein said outer shell has a metallic appearance.

11. A casket display system as in claim 9, wherein said outer shell has a fabric-like appearance.

12. A casket display system as in claim 9, wherein said outer shell has a classical column appearance.

13. A casket display system as in claim 1, wherein each of said cylinders is cylindrical.

14. A casket display system as in claim 1, wherein each of said cylinders is tubular.

15. A casket display system as in claim 1, comprising at least one connecting member, each said connecting member attached to and connecting together at least two of said cylinders.

16. A casket display system as in claim 15, wherein said connecting member is attached to each of said cylinders along substantially all of its vertical height.

17. A casket display system as in claim 15, wherein said connecting member is attached to each of said cylinders along all of its vertical height.

18. A casket display system as in claim 1, wherein each said connecting member acts to support a skirting material between said cylinders.

19. A casket display system as in claim 1, wherein each said supporting member is releasably attached to at least one of said cylinders and to said back wall panel.

20. A casket display system as in claim 1, comprising two said supporting members.

21. A casket display system as in claim 1, wherein said at least one supporting member provides all support required to maintain said back wall panel in a vertical position.

22. A casket display system as in claim 1, wherein said supporting members provide support to said back wall panel, and said back wall panel is adapted to receive additional support.

23. A casket display system as in claim 22, wherein said casket display system is arranged in back-to-back relation with a second casket display system, and said back wall panel of each said casket display system receives support from said back wall panel of the other said casket display system.

24. A casket display system as in claim 23, wherein said back wall panel receives additional support from a portion of a building in which said structure is disposed.

25. A casket display system as in claim 1, wherein said supporting member comprises a tubular material.

26. A casket display system as in claim 1, wherein said supporting member comprises a solid material.

27. An assembly kit for a casket display system, comprising:

a back wall panel, a plurality of cylinders adapted to form a bier to support a casket, at least one supporting member, each said supporting member adapted to be supported by at least one of said cylinders and adapted to provide support for said back wall panel.

28. An assembly kit for a casket display system as in claim 27, further comprising at least one connecting member, each said connecting member adapted for attachment to and for forming a connection between at least two of said cylinders.

29. An assembly kit for a casket display system as in claim 27, wherein said back wall panel comprises at least two sections.

30. An assembly kit for a casket display system as in claim 28, wherein said back wall panel comprises four sections, whereby said panel is foldable about said in an accordion fashion.

31. An assembly kit for a casket display system as in claim 28, wherein said back wall comprises four spline interlock sections.

32. An assembly kit for a casket display system as in claim 30, wherein said panel is about eight feet wide and four feet high and each of said sections has a height of about four feet and a width of about two feet, whereby said panel may be reduced in size to attain a height of about four feet and a width of about two feet.

33. An assembly kit for a casket display system as in claim 28, wherein each of said plurality of cylinders has a weight small enough for hand transport by a human.

34. An assembly kit for a casket display system as in claim 28, wherein each of said cylinders comprises a removable outer shell having an appearance selectable to match or complement a casket supported thereon.

35. An assembly kit for a casket display system as in claim 34, wherein said outer shell has a wood grain appearance.

36. An assembly kit for a casket display system as in claim 35, wherein said outer shell has a metallic appearance.

37. An assembly kit for a casket display system as in claim 35, wherein said outer shell has a fabric-like appearance.

38. An assembly kit for a casket display system as in claim 35, wherein said outer shell has a classical column appearance.

39. An assembly kit for a casket display system as in claim 28, wherein each of said cylinders is cylindrical.

40. An assembly kit for a casket display system as in claim 28, wherein each of said cylinders is tubular.

41. An assembly kit for a casket display system as in claim 28, comprising at least one connecting member, each said connecting member attached to and connecting together at least two of said cylinders.

42. An assembly kit for a casket display system as in claim 28, wherein each said supporting member is releasably attached to at least one of said cylinders and to said back wall panel.

43. An assembly kit for a casket display system as in claim 28, comprising two said supporting members.

44. An assembly kit for a casket display system as in claim 28, wherein said supporting member comprises a tubular material.

45. An assembly kit for a casket display system as in claim 28, wherein said supporting member comprises a solid material.

* * * * *

UNITED STATES PATENT AND TRADEMARK OFFICE

CERTIFICATE OF CORRECTION

PATENT NO. : 5,901,863
DATED : May 11, 1999
INVENTOR(S) : Riga et al.

It is certified that error appears in the above-identified patent and that said Letters Patent is hereby corrected as shown below:

Drawings,
Delete Sheet 6 of the drawings in its entirety and substitute the attached Sheet 6.
Delete Sheet 12 of the drawings in its entirety and substitute the attached Sheet 12.
Add attached new Figure 23 as Sheet 13 of the drawings.

Figure 23:
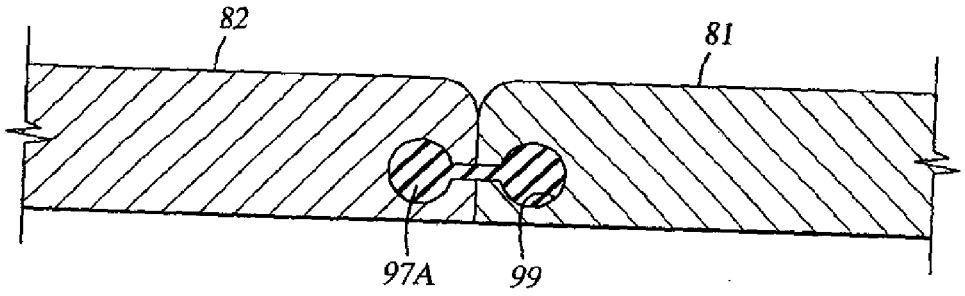

Column 4,
After line 12, add the following paragraph:

-- FIG. 23 is a cross-sectional view of an embodiment of the back wall panel including a flexible splined joint between sections of the back wall panel, in accordance with an embodiment of the invention. --
Line 13, delete "22" and substitute -- 23 -- therefor.

Signed and Sealed this

Second Day of November, 2004

JON W. DUDAS
*Director of the United States Patent and Trademark Office*